US005657813A

United States Patent [19]

Eraña

[11] Patent Number: 5,657,813

[45] Date of Patent: Aug. 19, 1997

[54] CORE BLOWING MACHINE BLOWING PLATE EXCHANGING AND CLEANING SYSTEM

[75] Inventor: Agustin Arana Eraña, Vitoria, Spain

[73] Assignee: S.A. Loramendi, Alava, Spain

[21] Appl. No.: 683,770

[22] Filed: Jul. 17, 1996

[30] Foreign Application Priority Data

Aug. 2, 1995 [ES] Spain ..... 9501572

[51] Int. Cl.[6] ..... B22C 15/24; B22C 19/00; B22C 23/00

[52] U.S. Cl. ..... 164/158; 164/200

[58] Field of Search ..... 164/158, 121, 164/200, 228, 412

[56] References Cited

U.S. PATENT DOCUMENTS 5,544,694 8/1996 Landua et al. ..... 164/200 X

FOREIGN PATENT DOCUMENTS 58-163548 9/1983 Japan ..... 164/158
63-273549 11/1988 Japan ..... 164/200
2193916 2/1988 United Kingdom ..... 164/158

*Primary Examiner*—J. Reed Batten, Jr.
*Attorney, Agent, or Firm*—Ladas & Parry

[57] ABSTRACT

The system has a pivoting frame (1) attached to a core-making machine, including a support (2) fitted with two symmetrically arranged trays (4) having centering elements (6) and clamps (7) to receive and hold two blowing plates, namely a clean plate (19) and a plate to be cleaned (18). The pivoting frame pivots the frame (1), turns the support (2) and travels a blowing head (17) in sequence such that the plate to be cleaned is collected by the support (2) and the clean plate is collected by the blowing head (17).

6 Claims, 5 Drawing Sheets

CORE BLOWING MACHINE BLOWING PLATE EXCHANGING AND CLEANING SYSTEM

OBJECT OF THE INVENTION

The present invention relates to a core blowing machine blowing plate exchanging and cleaning system which is clearly aimed at allowing blowing plates used in core blowing machines to be simply, effectively and quickly exchanged and cleaned, the blowing head being therefor provided to travel until it is upwardly facing a pivoting support carrying a clean blowing plate and designed to collect and hold the blowing plate that is to be cleaned, thereby for the dirty plate to be extracted by means of appropriate chain operations, the replacement plate being thereupon inserted, and the machine being thus able to work while the dirty plate is being cleaned.

BACKGROUND OF THE INVENTION

In core-making machines it is indispensable to clean the blowing plates from time to time, for the sand-binder accumulates on such plates and may result in clogging of the sand flow nozzles, which would eventually result in a faulty and defective filling of the core box, to which sand arrives through the blowing plate.

In the type of core-making machines aforesaid, it is consequently necessary to clean the actual blowing plates from time to time, to which end the plates must be extracted from the machines, cleaned and then properly rearranged on said machines.

Now then, these extraction, cleaning and subsequent mounting operations require considerable time periods during which the machine must be stopped, thereby losing on production.

Devices are known to be designed to receive and fix the blowing plates, which may pivot from a horizontal to an upright or near-upright position, to eliminate sand remains, by scraping the plate or otherwise.

Reference could in this sense be made to U.S. Pat. No. 4,572,273 which describes a mechanism provided with a pivoting platform, which pivots due to the assistance of a pair of hydraulic cylinders, which platform and said hydraulic cylinders are associated to a moveable carriage which may travel along vertical guides on a fixed support and with the assistance of another hydraulic cylinder, thereby for the latter cylinder to provide the vertical travel of the platform and consequently of the blowing plate and the core box relative to the top blowing head, whereas the first pair of cylinders allow the platform to pivot for the blowing plate to be cleaned. A fourth hydraulic cylinder, arranged crosswise, allows the blowing plate to be fixed to and released from the pivoting platform.

Although cleaning of the blowing plate is made easier with this solution, the machine still ceases production whilst it is being cleaned. The solution is moreover unduly complex from a structural standpoint.

Another solution may be found in Spanish Patent number 8800929 (U.S. Pat. No. 4,899,802) of the same applicant, which describes a device aimed at making cleaning of the blowing plate easier, which device comprises a frame which may travel vertically along the relevant guides, a tray receiving the blowing plate that is to be removed from the machine to be cleaned being hinged to said frame. A single hydraulic cylinder causes the frame to travel and the tray with the blowing plate fixed thereto to be lowered.

This clearly simple solution does not prevent the machine from remaining inactive either, whilst the blowing plate is being cleaned.

SUMMARY OF THE INVENTION

The system proposed by the invention is devised to fully solve the foregoing problems, since it is provided for the blowing plates in core blowing machines to be exchanged and appropriately cleaned remarkably quickly and almost without any idle time in machine production.

The system of the invention specifically lies in that a pivoting frame is mounted on a lateral or end portion of the machine, including a rotatory support designed to house a clean blowing plate and to receive the blowing plate extracted from the machine to be cleaned, which support is provided with a number of holes to reduce its weight and has two symmetrically arranged trays, namely top and bottom trays, receiving the blowing plates, said support being contemporaneously fitted with blowing plate centering and positioning elements and clamps to hold the blowing plates.

As explained before, said support is designed to be able to rotate and has an appropriate mechanism which allows the position of the trays and consequently of the plates lying thereon to be inverted, said rotating mechanism preferably consisting of two hydraulic cylinders acting upon two racks, which in turn drive a rack pinion to generate the turning movement of said support, being particular in that said rotation is limited in both directions by the relevant stop.

On the other hand, it is noteworthy that the subject support is internally fitted with a divider wall provided to prevent any sand remaining on the plate to be cleaned, from dropping onto the clean plate when the support is made to turn.

The system is complemented with guide means provided on the top of the machine, allowing the blowing head of said machine to travel from the machine to the relevant position facing said rotatory support provided on the pivoting frame, the above in accordance with an operative sequence which entails pivoting of said frame, turning of the support, travelling of the blowing head, positioning of the blowing plates on the support, turning of the support, thereby for the cycle to be repeatedly performed as many times as required in order for the blowing plates of the relevant core blowing machine to be cleaned, for based upon the above the machine can carry on working with a blowing plate whilst the other is being cleaned, with the consequent economic savings, since the machine will not be forced to stop as is conventionally the case.

DESCRIPTION OF THE DRAWINGS

In order to provide a fuller description and contribute to the complete understanding of the features of this invention, a set of drawings is attached to the specification which, while purely illustrative and not fully comprehensive, shows the following.

PREFERRED EMBODIMENT OF THE INVENTION

Figure 1:
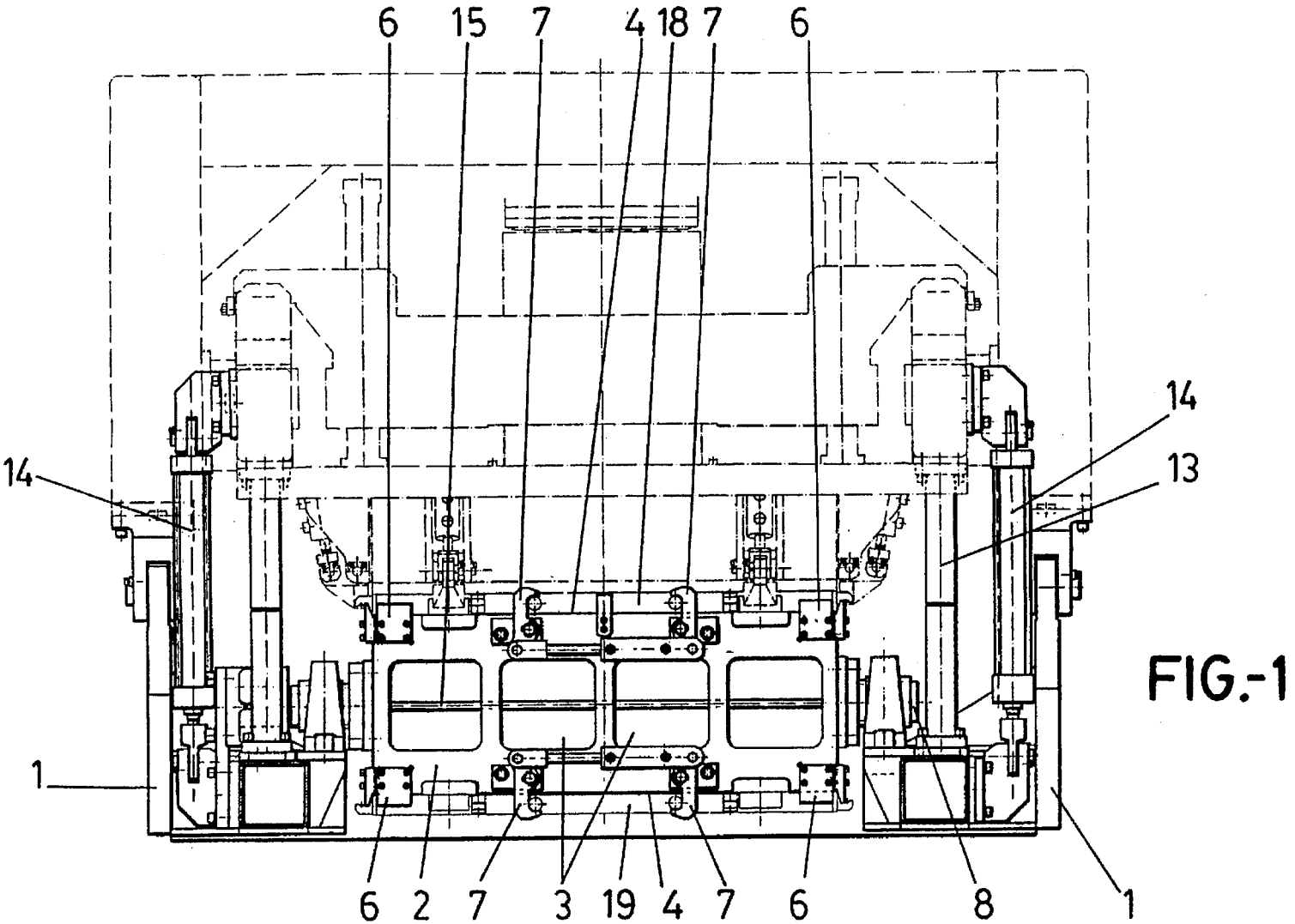
FIG. 1.—Is a side elevation view of the assembly consisting of the pivoting frame with the rotatory support carrying the trays for the blowing plates to be arranged, at position 4*d* of the sequence of movements, i.e. with the plate to be cleaned on the top tray and the replacement plate on the bottom tray.
Figure 2:
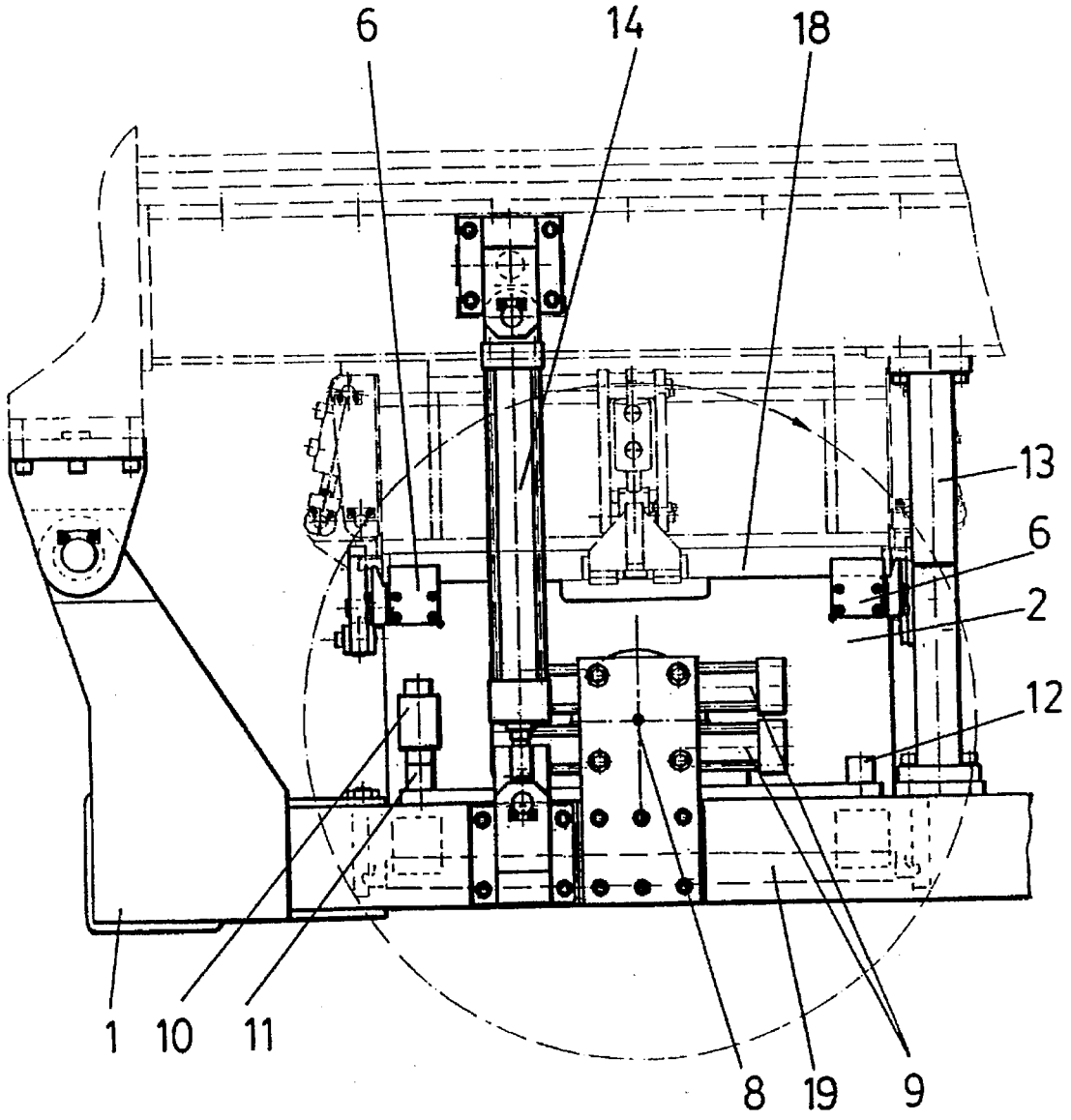
FIG. 2.—Is another side view, now of a face perpendicular to that shown in the preceding figure, of the same mechanism, at position 4*d* of the sequence of movements, i.e. with the plate to be cleaned on the top tray and the replacement plate on the bottom plate.
Figure 3:
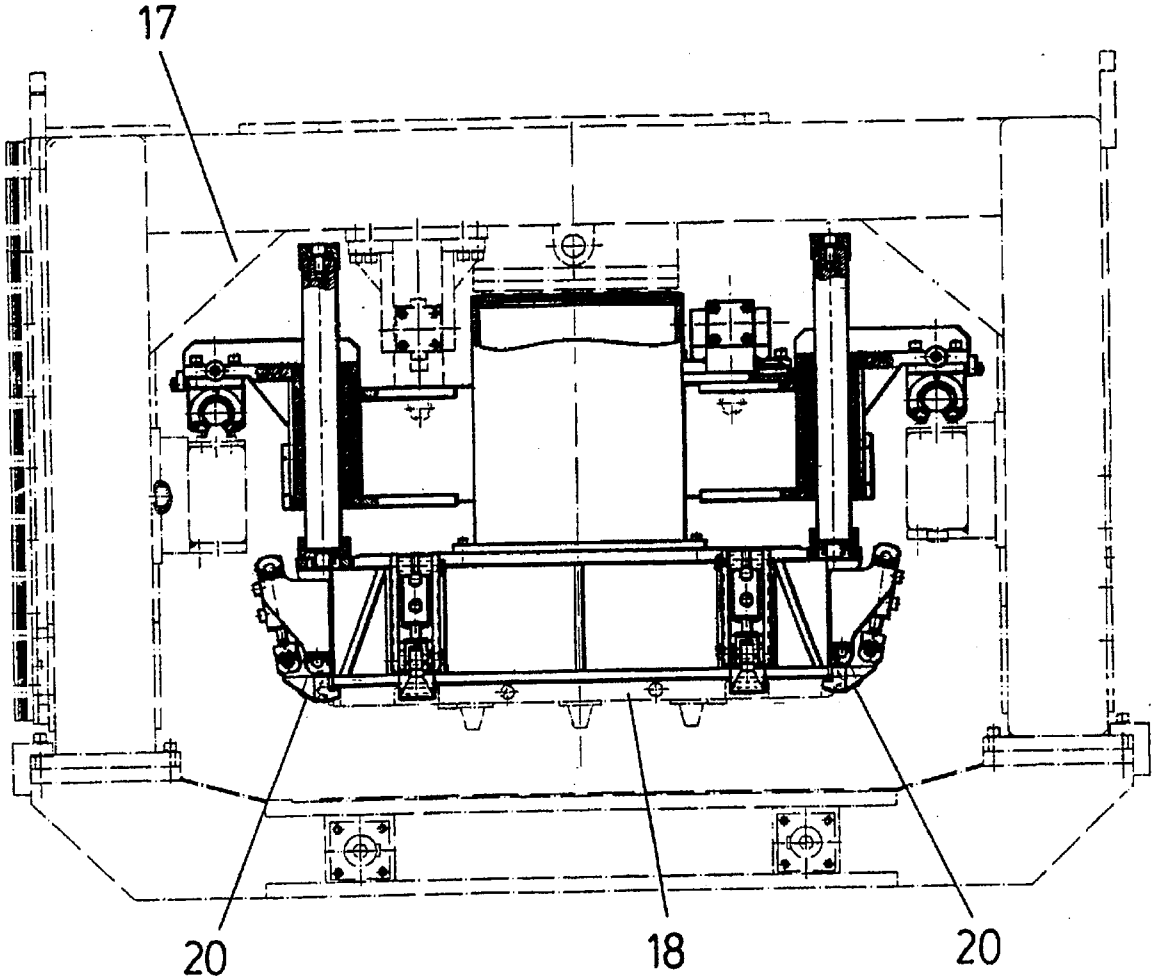
FIG. 3.—Is a close-view of an elevation of the blowing head forming part of the machine, to which the system of the invention is applicable.

With reference to the figures, and firstly FIGS. 1, 2 and 3, the system of the invention, which applies to core blowing machines and is designed to carry out the exchange and cleaning of the relevant blowing plates (18) of the machine, consists of a pivoting frame (1) mounted on a side of the machine, i.e. attached thereto, which frame (1) has a rotatory support (2) designed to receive and hold the blowing plate (18) to be cleaned, as explained hereinafter, and contemporaneously having a clean plate (19) which will be collected by the blowing head.

The rotatory support (2) has a number of holes (3) to lighten its weight, and two symmetrically arranged trays (4) where the blowing plates (18) and (19) lie, and is moreover provided with centering elements (6) to arrange such blowing plates (18) and (19), and clamps (7) to hold the same.

On the other hand, the support (2) is provided with a rotating mechanism (8) which allows the position of the trays and consequently of the plates lying thereon to be inverted. As shown in the figures, this device may for instance consist of two hydraulic cylinders (9) moving two racks which act on a rack pinion to generate a turning movement. Rotation of the support (2) is limited in both directions by a stop (10), and the support (2) therefore turns at all times until it respectively abuts against protuberances (11) or (12) provided on the frame (1).

The frame (1) carrying the support (2) pivots from a horizontal position thereof down to a pivoted position determined by the pivoting stops (13) and vice versa, and does so by action of two hydraulic cylinders (14).

The support (2) is internally provided with a divider wall (15) designed to prevent any sand remaining on the plate to be cleaned from dropping onto the clean plate when the support is turned.

Finally, the system of the invention includes guide means (16) at the top to allow the blowing head (17) to travel from inside the core-making machine to a position matching that of the support (2).

Figure 4D:
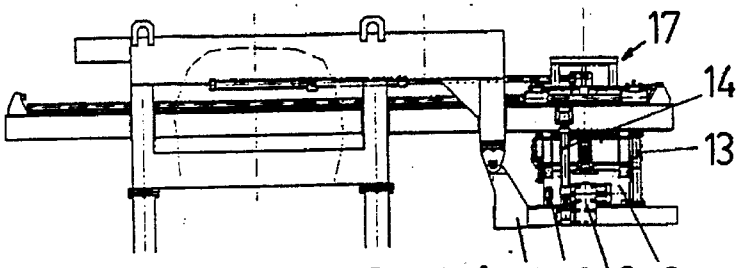
FIGS. 4*a* to 4*k*.—Are the same number of close-views of different stages or sequences in the change of blowing plate of the system of the invention.
Figure 4E:
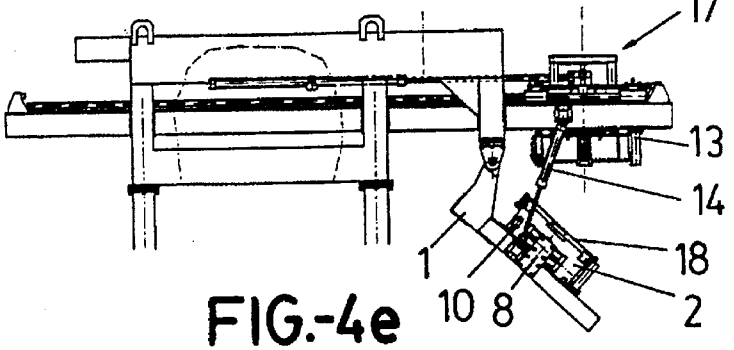
Figure 4F:
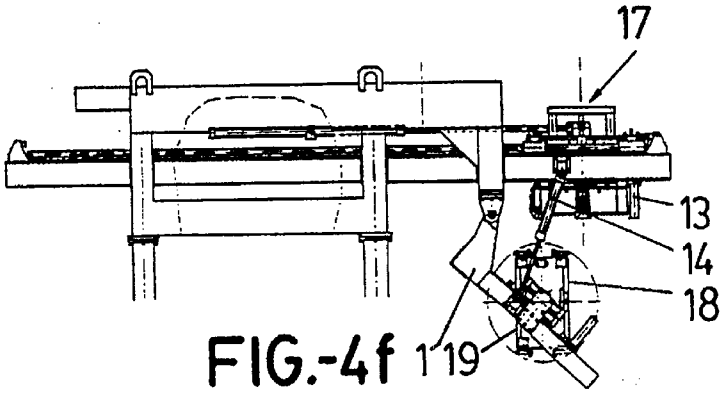
Figure 4A:
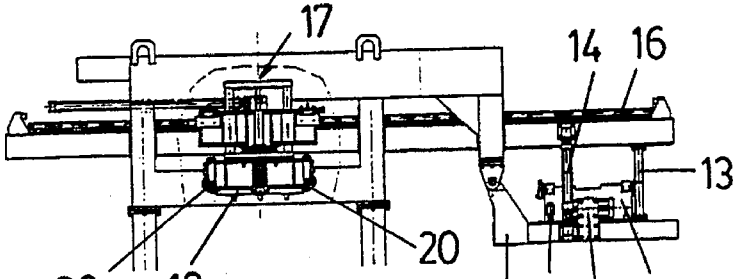
Figure 4B:
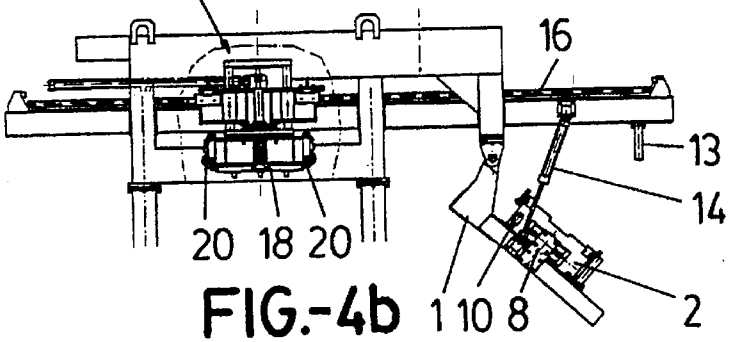

As explained above and shown in FIGS. 4*a* to 4*k*, operation is as follows:

The frame (1) pivots down to the limiting position shown in FIG. 4*b*.

Figure 4C:
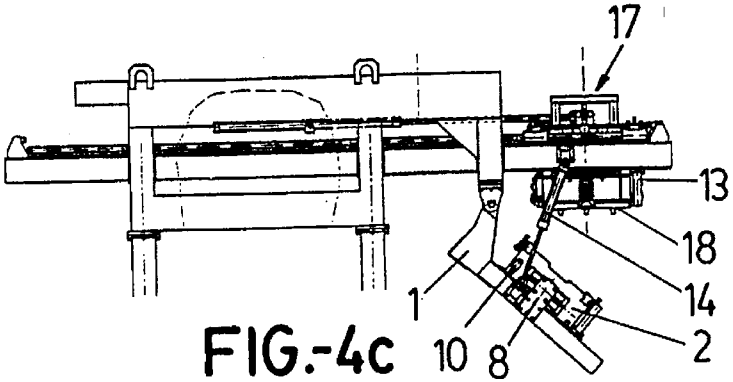
Figure 4J:
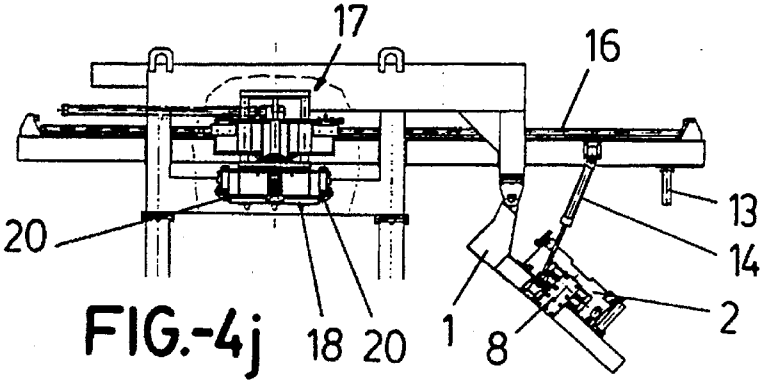
Figure 4K:
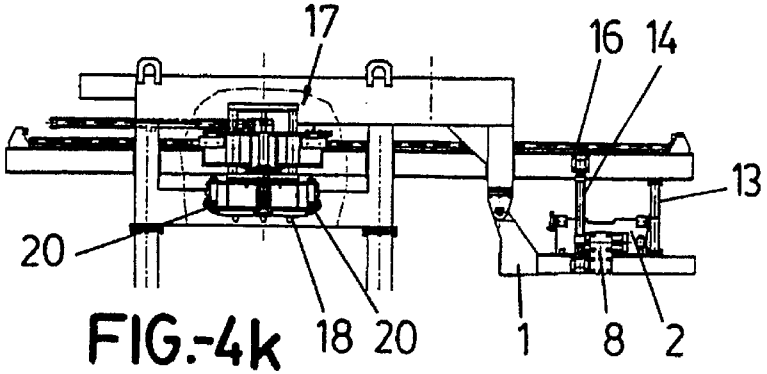
Figure 4G:
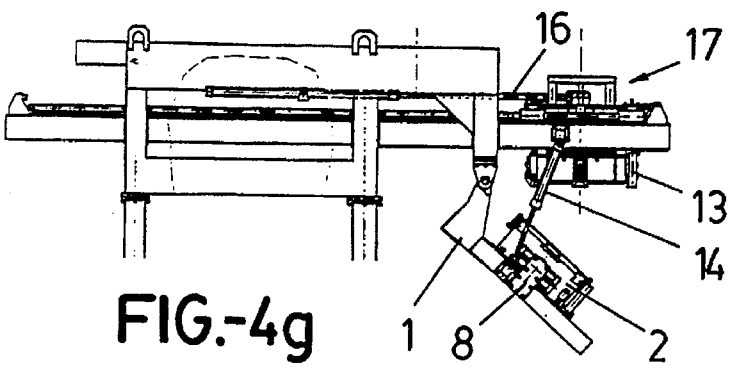
Figure 4H:
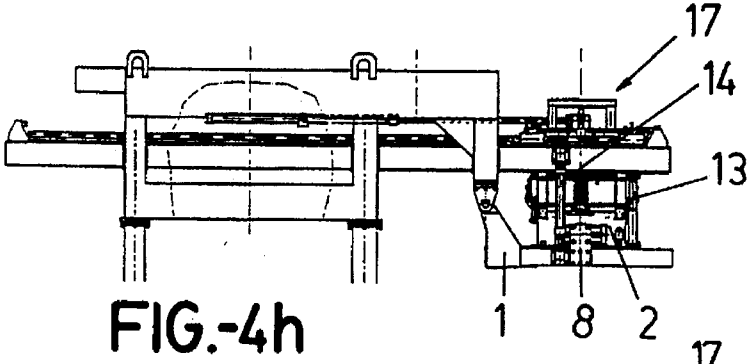

The blowing head (17), with the blowing plate (18) to be cleaned, is taken out of the machine up to the cleaning position illustrated at the position shown in FIG. 4*c*.

The frame (1) turns from the maximum pivoting position up to the horizontal position, which matches the position of FIG. 4*d*. In this position, the clamps (20) of the blowing head (17) open, placing the blowing plate (18) on the top tray of the support (2). The plate is centered and held by the elements (6) and clamps (7).

The frame (1) with the dirty blowing plate (18) held on the support (2) pivots down to the limiting position, which matches the position of FIG. 4*e*.

The support (2) turns completely until the stop (10) abuts against the protuberance (12), as in the position of FIG. 4*f*, the dirty plate (18) lying at the bottom of the support (2) and the clean plate (19) at the top. The position of FIG. 4*g*.

The frame (1) pivots up to the horizontal position. The clamps (20) of the blowing head (17) are closed, holding the new blowing plate (19). The position of FIG. 4*h* of the sequence.

Figure 4I:
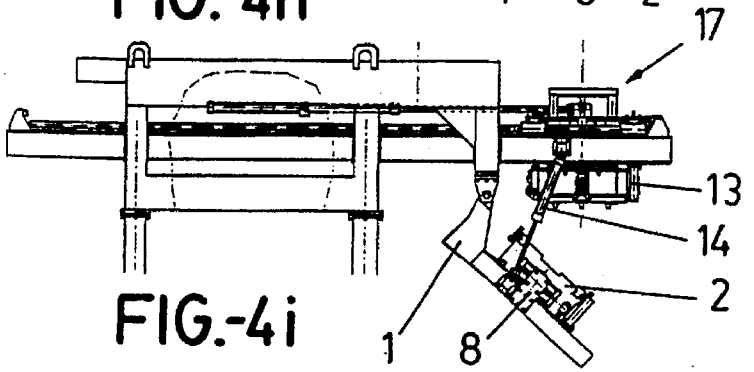

The frame (1) pivots down to the limiting position, as shown in the position of FIG. 4*i* of the sequence.

The blowing head (17) moves back to take up its working position inside the machine, the frame (1) remaining pivoted. Position 4*j* of the sequence.

The frame (1) pivots up to the horizontal position, the dirty plate (18) remaining at the bottom, ready to be cleaned, while the machine continues with a new blowing cycle using the clean plate.

Once the blowing plate has been cleaned, it can be reused in the blowing machine, whereupon a new cycle as described above is repeated, in which the dirty plate is removed from the machine and arranged on the top of the support (2). The support will then turn, thereby for the lower plate, which is clean, to move to the top and from there into the machine, whereas the dirty plate will then lie at the bottom to be cleaned.

The foundation of this machine lies in that the support (2) has two trays or housings (4) for the plates, one to house a clean plate and another one for the plate to be cleaned, which, by means of the steps described in the sequence, move from the machine to the cleaning station and vice versa, allowing the blowing machine to work whilst the dirty plate is being cleaned.

I feel that the description need not be extended any longer for any expert in the art to have grasped the full scope of the invention and the advantages it offers.

I claim:

1. A core blowing machine blowing plate exchanging and cleaning system, comprising a pivoting frame (1) attached to a core-making machine, including a support (2) fitted with two symmetrically arranged trays (4) having centering elements (6) and clamps (7) to receive and hold two blowing plates, namely a clean plate (19) and a plate to be cleaned (18), the pivoting frame having pivoting means for pivoting the pivoting frame (1), turning the support (2) and travelling a blowing head (17) in sequence such that the plate to be cleaned is collected by the support (2) and the clean plate is collected by the blowing head (17).

2. The core blowing machine blowing plate exchanging and cleaning system as in claim 1, and further comprising a rotating mechanism means (8) fitted with the support (2) for inverting the position of the trays, the rotating mechanism means consisting of two hydraulic cylinders (9) for moving respective racks, the racks acting upon a rack pinion to generate a rotating movement.

3. The core blowing machine blowing plate exchanging and cleaning system as in claim 1, and further comprising stop means (10) for limiting the turning of the support (2) in opposite directions, whereby the support (2) turns at all times until it abuts against the stop means (10), the stop means (10) comprising protuberances (11, 12) on the frame.

4. A core blowing machine blowing plate exchanging and cleaning system as in claim 1, wherein the pivoting means pivots the pivoting frame (1) from a horizontal position to a pivoted position, and further comprising pivoting stops (13) for determining the horizontal and pivoted positions and two hydraulic cylinders (14) in the pivoting means.

5. The core blowing machine blowing plate exchanging and cleaning system as in claim 1, and further comprising a divider in the support (2) for preventing sand from dropping from the plate to be cleaned onto the clean plate when the support (2) is turned.

6. The core blowing machine blowing plate exchanging and cleaning system as in claim 1, and further comprising guide means (16) on top of the system for allowing the blowing head (17) to travel from inside the core-making machine to a cleaning position matching a position of the support (2).

* * * * *